US005643007A

United States Patent [19]

Younger

[11] Patent Number: 5,643,007

[45] Date of Patent: Jul. 1, 1997

[54] TRANSFORMER TAP CONNECTOR

[75] Inventor: Harold R. Younger, Halifax, Va.

[73] Assignee: ABB Power T&D Company Inc., Raleigh, N.C.

[21] Appl. No.: 713,658

[22] Filed: Sep. 13, 1996

[51] Int. Cl.[6] ..... H01R 4/24

[52] U.S. Cl. ..... 439/421; 439/422; 174/94 R

[58] Field of Search ..... 439/421, 422, 439/425, 426, 434, 435, 492, 387; 174/94 R, 94 S

[56] References Cited

U.S. PATENT DOCUMENTS

| | | | |
|---|---|---|---|
| 2,551,970 | 5/1951 | Sampson | 173/324 |
| 3,344,316 | 9/1967 | Stelmak | 439/426 |
| 3,541,227 | 11/1970 | Bendrick | 174/94 R |
| 3,668,613 | 6/1972 | Klosin | 339/97 |
| 3,728,473 | 4/1973 | Kuo | 174/94 R |
| 3,880,488 | 4/1975 | Collier et al. | 339/97 C |
| 3,881,796 | 5/1975 | Saunders | 339/97 |
| 4,116,522 | 9/1978 | Reynolds | 339/97 R |
| 4,199,211 | 4/1980 | Kidder | 339/98 |
| 4,310,212 | 1/1982 | Aujla et al. | 339/97 R |
| 4,455,057 | 6/1984 | Mariani | 339/97 C |
| 4,620,755 | 11/1986 | Yonkers et al. | 339/14 L |
| 4,904,203 | 2/1990 | Wang | 439/399 |
| 5,356,306 | 10/1994 | Ackerman et al. | 439/387 |

FOREIGN PATENT DOCUMENTS

| | | | |
|---|---|---|---|
| 0230669 | 9/1990 | Japan | 439/426 |
| 145074 | 6/1991 | Japan | 439/492 |

*Primary Examiner*—David L. Pirlot
*Assistant Examiner*—Tho D. Ta
*Attorney, Agent, or Firm*—Woodcock Washburn Kurtz Mackiewicz & Norris LLP

[57] ABSTRACT

A metal piercing staple for piercing, securing and making electrical contact between a pair of wires in the form of a substantially U-shaped piece of metal having sharp ends and a plurality of metal piercing teeth depending from the U-shaped piece of metal between the sharp ends.

3 Claims, 1 Drawing Sheet

TRANSFORMER TAP CONNECTOR

FIELD OF THE INVENTION

This invention relates to an electrical connector for piercing, securing and making electrical contact between a pair of wires and it relates more particularly to a connector for making a transformer tap connection.

BACKGROUND OF THE INVENTION

There have been no novel methods of making transformer tap connections without existing welding practices which is a problem when joining dissimilar metals other than cold pressure welding which is limited to the combined metal thickness of the tap lead and the coil conductor. Even with cold pressure welding, the insulation must be removed from both the tap lead and the coil conductor and both must be free from metal oxides to assure a sound electrical joint. Mechanical connections, such as crimping, create a bulge in the transformer coil which is not desirable.

It would be desirable to utilize a staple like connector with penetrating teeth to penetrate both the tap lead and the coil conductor with the insulation system still in tact assuring a solid electrical connection. By using the staple like connector only to penetrate the top and bottom of the conductor joint, any bulge in the transformer coil itself would be minimized. Such a staple like connector would be suitable for joining dissimilar metals such as copper to aluminum or aluminum to copper as well as joining like metals.

SUMMARY OF THE INVENTION

It is an object of the invention to provide a metal piercing staple for piercing, securing and making electrical contact between a pair of wire comprising a substantially U-shaped piece of metal and having sharp ends and a plurality of metal piercing teeth depending from the U-shaped piece of metal between the sharp ends.

In accordance with the present invention there is provided an electrical connector for piercing, securing and making electrical contact between a wire having a conductor and outer insulation and a flat wire having a flat conductor and outer insulation. The connector comprises a substantially U-shaped metal body having a back and a pair of legs depending therefrom, the legs being spaced apart a distance at least as great as the width of the flat wire. A plurality of metal piercing teeth depend from the back intermediate the pair of legs, the teeth having a length greater than the thickness of the flat wire and adequate to pierce the flat wire conductor and outer insulation and penetrate the outer insulation and conductor of the first-named wire so as to make electrical contact between the conductor and the flat conductor. The pair of legs have a length and shape for penetrating the outer insulation and conductor of the first-named wire for securing the flat wire and the first-named wire together and maintaining electrical contact between the conductors of the wires. In the preferred embodiment of the invention the ends of the pair of legs have barb structure for resisting removal of the legs from the penetrated position thereof in the first-named wire.

DETAILED DESCRIPTION OF THE PREFERRED EMBODIMENT

Figure 1:
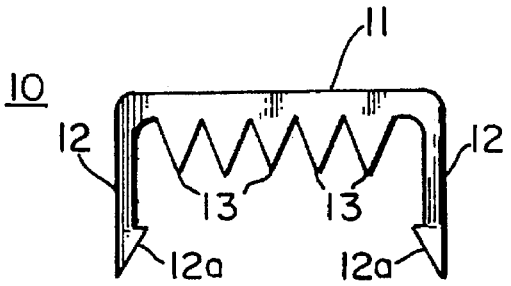
FIG. 1 is a side view of an electrical connector embodying the present invention.
Figure 2:
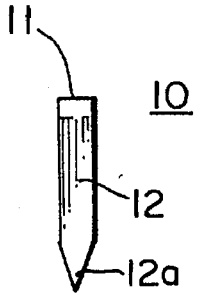
FIG. 2 is an end view of the electrical connector shown in FIG. 1.

Referring to FIGS. 1 and 2 there is illustrated an electrical connector 10 embodying the present invention. As shown in FIG. 1 the connector 10 comprises a substantially U-shaped metal body having a back portion 11 with a pair of legs 12 depending therefrom. The legs 12 have sharp ends 12*a* in the form of barbs and the back 11 has a plurality of metal piercing teeth 13 depending therefrom intermediate the pair of legs.

Figure 3:
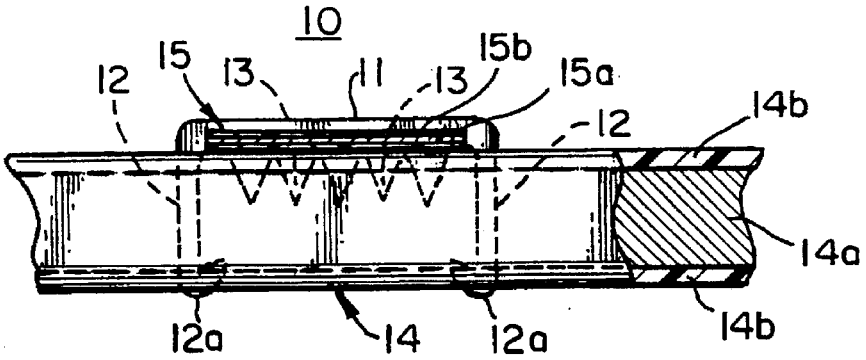
FIG. 3 is a view showing the electrical connector of FIG. 1 securing together a tap lead and a conductor.
Figure 4:
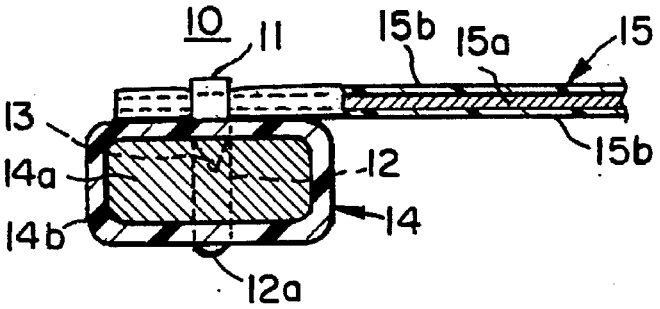
FIG. 4 is an end view of the assembly shown in FIG. 3.

As shown in FIGS. 3 and 4 the electrical connector 10 is adapted for piercing, securing and making electrical contact between a wire 14 having a conductor 14*a* and outer insulation 14*b* and a flat wire 15 having a flat conductor 15*a* and outer insulation 15*b*. As shown in FIG. 3 the legs 12 are spaced apart a distance at least as great as the width of the flat wire 15. The plurality of metal piercing teeth 13 depending from the back 11 intermediate the pair of legs 12 have a length greater than the thickness of the flat wire 15 and adequate to pierce the flat wire conductor 15*a* and outer insulation 15*b* and penetrate the outer insulation 14*b* and conductor 14*a* of the wire 14 so as to make electrical contact between the conductor 14*a* and the flat wire conductor 15*a*. As shown in FIGS. 3 and 4 the pair of legs 12 have a length and shape for penetrating the outer insulation 14*b* and conductor 14*a* of wire 14 for securing the flat wire 15 and the wire 14 together and maintaining electrical contact between the conductors 14*a* and 15*a* respectively of the wires 14 and 15. As shown in FIG. 3 there ends of the pair of legs 12 have barb structure 12*a* for resisting removal of the legs 12 from the penetrated position thereof in the wire 14.

The connector 10 is made from a suitable metal and preferably one having adequate strength to enable the teeth to pierce the flat wire conductor 15*a* and outer insulation 15*b* of the flat wire 15 and to penetrate the outer insulation 14*b* and conductor 14*a* of the wire 14. The metal from which the connector 10 is constructed also should have adequate strength so that the legs 12 will penetrate the outer insulation 14*b* and conductor 14*a* of the wire 14 for securing the flat wire 15 to the wire 14 and maintaining electrical contact between the conductors 14*a* and 15*a* of the wires 14 and 15. An example of a suitable metal from which to construct the connector 10 is plated hard copper to eliminate oxidation of the copper or steel plated with an electrical conductive coating.

From the foregoing it will be seen that the connector 10 of the present invention is particularly suited to making transformer tap connections by connecting the tap lead and the coil conductor together with the insulation system still in tact assuring a solid electrical connection. Any bulge in the transformer coil itself is minimized since the connector 10 is only used to penetrate the top and bottom of the conductor joint. The connector 10 of the present invention is not only suitable for joining dissimilar metals such as copper to aluminum or aluminum to copper but is also suitable for joining similar metals as well as metals of varying thickness.

While the present invention has been described and illustrated particularly in connection with making transformer tap connections, it will be recognized that the connector of the present invention is also suitable for making electrical connection between other types of electrical conductors.

What is claimed is:

1. An electrical connector for piercing, securing and making electrical contact between a wire having a conductor and outer insulation and a flat wire having a flat conductor and outer insulation comprising:

a substantially U-shaped metal body having a back and a pair of legs depending therefrom, said legs being spaced apart a distance at least as great as the width of the flat wire, a plurality of metal piercing teeth depending from said back intermediate said pair of legs, said teeth having a length greater than the thickness of the flat wire and adequate to pierce the flat wire conductor and outer insulation and penetrate the outer insulation and conductor of said first-named wire so as to make electrical contact between said conductor and said flat conductor, and said pair of legs having a length and shape for penetrating the outer insulation and conductor of said first named wire for securing said flat wire and said first named wire together and maintaining electrical contact between the conductors of said wires.

2. An electrical connector according to claim 1 wherein the ends of said pair of legs have barb structure for resisting removal of said legs from the penetrated position thereof in said first named wire.

3. A metal piercing staple for piercing, securing and making electrical contact between a pair of wires comprising a substantially U-shaped piece of metal having sharp ends and a plurality of metal piercing teeth depending from said U-shaped piece of metal between said sharp ends.

* * * * *